US007472438B2

(12) United States Patent
Karmer, Jr. et al.

(10) Patent No.: US 7,472,438 B2
(45) **Date of Patent: *Jan. 6, 2009**

(54) BARIATRIC TRANSPORT WITH IMPROVED MANEUVERABILITY

(75) Inventors: DuWayne E. Karmer, Jr., Lake Quivera, KS (US); James E. Ernst, Kansas City, KS (US); Timothy F. Dunfee, Lake Quivera, KS (US); Brian W. Mellies, Stillwell, KS (US)

(73) Assignee: Burke, Inc., Kansas City, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/877,887

(22) Filed: Oct. 24, 2007

(65) Prior Publication Data

US 2008/0040857 A1 Feb. 21, 2008

Related U.S. Application Data

(63) Continuation of application No. 11/167,990, filed on Jun. 27, 2005, now Pat. No. 7,302,722.

(60) Provisional application No. 60/585,209, filed on Jul. 2, 2004.

(51) Int. Cl.
*A61G 7/08* (2006.01)

(52) U.S. Cl. ..... 5/600; 5/86.1; 5/510

(58) Field of Classification Search ..... 5/600, 5/86.1, 181, 185, 510
See application file for complete search history.

(56) References Cited

U.S. PATENT DOCUMENTS

| | | | | |
|---|---|---|---|---|
| 5,083,625 | A | 1/1992 | Bleicher | |
| 6,178,575 | B1 | 1/2001 | Harada | |
| 6,390,213 | B1 | 5/2002 | Bleicher | |
| 6,516,479 | B1 * | 2/2003 | Barbour | 5/618 |
| 6,749,034 | B2 | 6/2004 | Vogel et al. | |
| 7,090,041 | B2 | 8/2006 | Vogel et al. | |
| 7,191,854 | B2 * | 3/2007 | Lenkman | 180/65.1 |
| 2007/0089238 | A1 | 4/2007 | Kramer et al. | |

* cited by examiner

*Primary Examiner*—Michael Trettel
(74) *Attorney, Agent, or Firm*—Husch Blackwell Sanders LLP

(57) ABSTRACT

A bariatric transport is provided. The transport includes a bed area for use by a bariatric patient. The transport further includes a drive assembly that is operable to selectively drive the transport in forward and rearward directions and permit turning of the transport with little or no lateral movement of the transport. Leading and trailing stabilizing wheel assemblies are provided that are selectively moveable into and out of engagement with a supporting floor. Drive devices are also provided to provide selective elevating and lowering of various components of bariatric patient supports.

19 Claims, 12 Drawing Sheets

BARIATRIC TRANSPORT WITH IMPROVED MANEUVERABILITY

CROSS-REFERENCE TO RELATED APPLICATIONS

This application is a continuation of and claims priority to Non-Provisional application Ser. No. 11/167,990, filed Jun. 27, 2005 entitled BARIATRIC TRANSPORT WITH IMPROVED MANEUVERABILITY, now U.S. Pat. No. 7,302,722, and Provisional Application Ser. No. 60/585,209, filed Jul. 2, 2004 entitled BARIATRIC TRANSPORT WITH IMPROVED MANEUVERABILITY, which applications are hereby incorporated by reference to the extent permitted by law.

BACKGROUND OF THE INVENTION

In recent years, the health care industry has become more aware of the needs that larger-sized patients have during hospitalization and other long term care stays. Those patients that exceed a certain weight and body mass index (BMI), typically 400 pounds and a BMI of 40, are referred to as "bariatric" patients. Bariatric patients often suffer from health ailments related to being bed ridden for extended periods of time, such as skin conditions and poor blood circulation. Additionally, bariatric patients are often difficult for health care providers or workers to physically lift and position because of their size. Injuries are common among nurses and nurse assistants working with these types of patients, and it is estimated that a single back injury to a provider costs the health care industry between $15,000 and $18,000.

To address these issues, special equipment has been devised for moving bariatric patients from place to place, and also to serve as their bed in health care facilities. A portable bariatric bed resting on a number of wheels is one such device, combining a mattress system configured to facilitate air circulation beneath the patient with an articulating frame that can be adjusted to a number of positions beneficial to moving the position of the patient on the mattress, as well as moving them into and out of the bed.

While advances have been made in bariatric bed design, significant problems still exist with maneuvering this type of equipment within a facility. Due to the sheer size of bariatric beds and the combined weight of both the bed and the patient (sometimes exceeding 1600 pounds), most health care workers find it difficult to push and steer these beds in a desired direction of travel. For instance, if a worker were pushing a loaded bariatric transport down a hallway and wished to turn right or left into a room, the inertia of the bed would make it difficult to slow down the speed of the bed and initiate rotation into a doorway. Further, workers may excessively strain themselves in attempting to steer the bed, putting a worker at risk for physical injuries, some of which could be career ending. The need to transport patients on such beds quickly and safely is even more acute in an emergency evacuation situation (e.g., fire, tornado, terrorism threat), where a finite number of workers must move a set number of patients into a safe area of a building or completely out of a building. With bariatric patients, as many as 5 or 6 workers may be required to maneuver the loaded bed, compromising their ability to care for other patients in need. Difficulties also arise in situations where a bed needs to be rotated in place without moving laterally too much in any direction (e.g., within a patient's room). Workers will often find that it is difficult to gauge and control whether the bed is actually rotating in place or "wandering" toward a wall, medical equipment, or other hazards.

Some portable hospital beds include a propulsion system for aiding a worker in moving the bed. However, existing powered bed designs are frequently complicated and often cannot be used to actually drive and steer the bed. Furthermore, such beds often lack an operator friendly control system for directing the bed in a desired movement pattern.

BRIEF SUMMARY OF THE INVENTION

Improvements over traditional portable bariatric bed designs are realized with a maneuverable bariatric transport employing a drive assembly and control system for increased maneuverability. The bariatric transport has a base frame onto which a patient support assembly is mounted, and front and rear stabilizing wheels depending downwardly from the base frame for supporting the transport on a floor or other surface. The patient support assembly may be articulated to a number of positions as needed for proper patient positioning on the transport. The drive assembly provides propulsion for the transport in a number of directions, as well as transport rotation in place with little or no lateral movement. The control system enables the operator to make inputs regarding desired movements for the transport, and to process those inputs into control signals directing operation of the drive assembly.

In one aspect, the drive assembly includes a drive motor employing axially-aligned output shafts extending in opposite directions, a pair of drive wheels, and a pair of gear boxes, each gear box interconnected one of the drive wheels with one of the output shafts. The output shafts each provide a torque that is transferred through the respective gear box to the respective drive wheel. Preferably, the drive wheels are positioned at or near the longitudinal midpoint of the base frame of the transport such that the transport can be rotated in place with little or no lateral movement across an underlying surface. A suspension may be provided to mount the drive assembly with the base frame and to ensure that the drive wheels maintain contact with an underlying surface when the transport is traveling over uneven terrain or transitioning between upwardly and downwardly sloping surfaces (e.g., ramps).

In another aspect, the control system includes a control module and an input device such as a joystick lever. The input device receives input signals from the operator about a desired movement pattern for the transport, such as straight forward or back, forward or back with a left or right turn, or rotation in place to perform a left or right turn, and generates a signal for transmission to the control circuitry. Upon receiving the signal, the control module directs the drive motor system to independently rotate the output shafts in a desired direction (i.e., clockwise or counterclockwise) and at a desired rotational speed or angular velocity. Additionally, based on operator input or lack thereof, the control module may direct the drive motor system to cease output shaft rotation to induce a braking effect for the transport.

Thus, the bariatric transport design of the present invention provides improved maneuverability and ease of operator use for transporting patients. The design is also highly beneficial to health care workers in that fewer patient transfers are necessary because the bariatric transport can serve as both a stationary bed and as a transport device for moving patients.

Additionally, emergency evacuations and the like can be achieved without unnecessary risk to an organization's staff or sibling staff.

BRIEF DESCRIPTION OF THE SEVERAL VIEWS OF THE DRAWING

In the accompanying drawings which form a part of the specification and which are to be read in conjunction therewith and in which like reference numerals are used to indicate like parts in the various views.

DETAILED DESCRIPTION OF THE INVENTION

Figure 1:
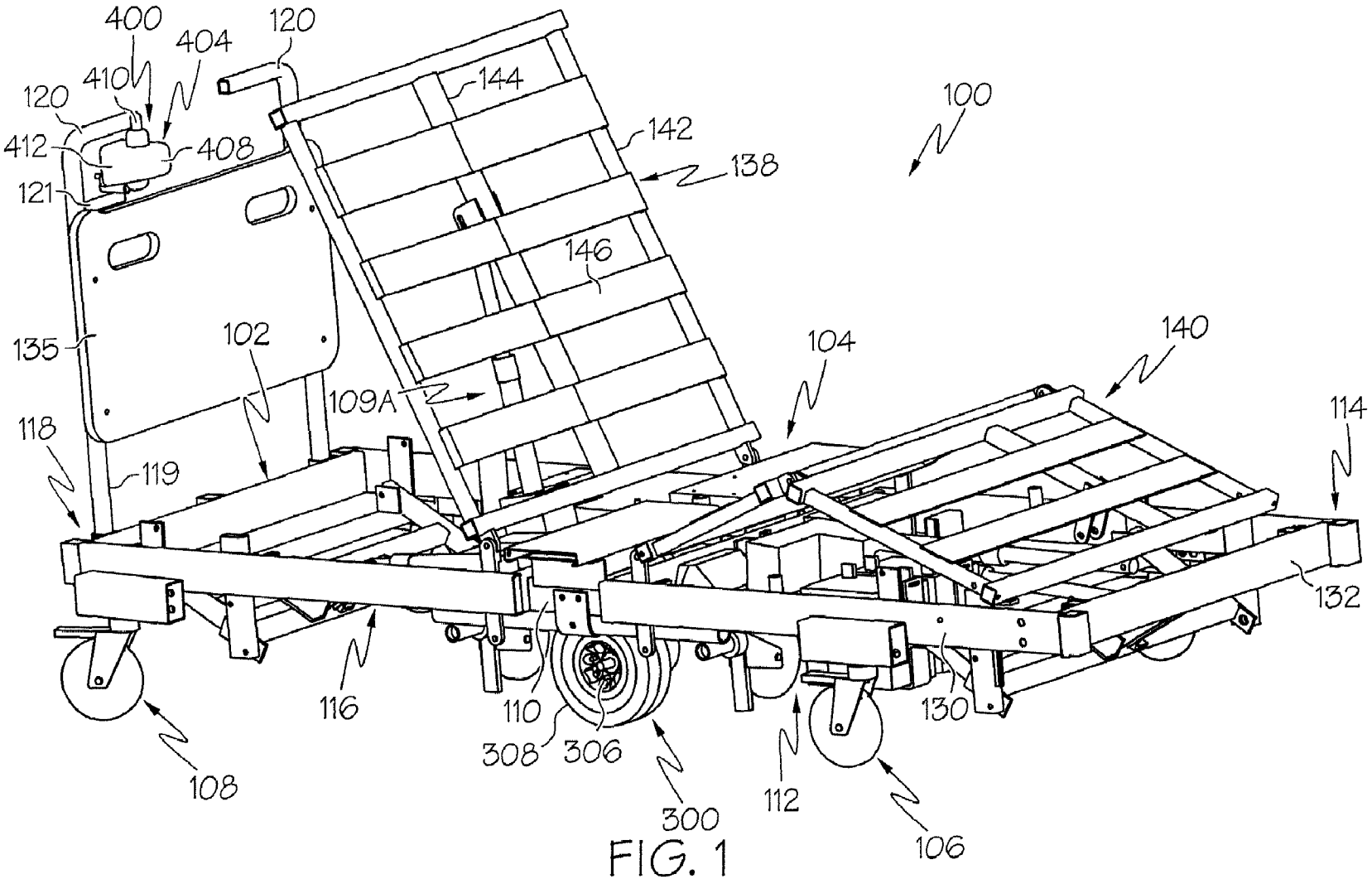
FIG. 1 is a front perspective view of a bariatric transport in accordance with one embodiment of the present invention.

Referring now to the drawings in greater detail, and initially to FIG. 1, one embodiment of a moveable bariatric bed transport for accommodating an obese person is represented by the reference numeral 100. The transport 100 includes generally a base frame 102, a patient support assembly 104 mounted onto the base frame 102, a drive assembly 300 having a pair of drive wheels 308 for propelling the transport 100 in a variety of movement patterns, and a control system 400 directing operation of the drive assembly 300 according to user selections. Preferably, a pair of leading stabilizing wheels 106 and trailing stabilizing wheels 108 provide support and balance the transport 100 on an underlying surface (e.g., a floor) when the drive assembly is in operation and serve as the means to allow movement of the transport 100 across the underlying surface manually when the drive wheels 308 are not engaging the surface. A number of actuators 109 mounted on the base frame 102 perform the functions of manipulating the position of the various components of the patient support assembly 104 as well as raising and lowering the base frame 102 relative to the underlying surface on which the transport 100 is resting, as will be discussed in further detail below with references to additional figures. Thus, the actuators 109 facilitate positioning of a patient in an orientation desired by the operator (e.g., health care worker) of the transport 100—specifically, the operator of the control system 400—and for lifting the drive wheels 308 off of the underlying surface for manual transport movement. The base frame 102, the patient support assembly 104, and the actuators 109 share a number of features in common with the bed of U.S. Pat. No. 6,516,479 entitled "Foldable Rehabilitation Bed for Accommodating an Obese Person" and issued to Barbour, the teachings of which are incorporated herein by reference. The actuators 109 are preferably linear actuators such as motor driven screws.

The base frame 102 of the transport 100 includes a center portion 110, a forward portion 112 extending from the center portion 110 to a forward end 114, and a back or aft portion 116 extending from the center portion 110 to a back end 118 in the opposite direction of the forward end 114. A pair of risers 119 extends upwardly from the back end 118 of the base frame 102 and curve inwardly towards one another to define a set of handles 120 at terminal ends of the risers 119. The handles 120 allow the operator to optionally manually move and steer the transport 100 either to aid the movement generated by the drive wheels 308, or to fully control transport movement when the drive assembly 300 is not contacting an underlying surface. The handles 120 may be at various orientations, e.g., inclined as shown, horizontal, or vertical. A central longitudinal axis of the transport 100 bisects the base frame 102 and may be used for positioning of the drive assembly 300, as will be discussed in further detail below. As used herein the terms "forward" and "back" are used in reference to the vantage point of the operator who is guiding the transport 100 in a direction of travel (i.e., with their hands on the handles 120). Thus, what is typically called the "foot" of the transport is considered the forward or leading end 114 of the transport 100, and what is called the "head" of the transport is considered the back or trailing end 118 of the transport 100.

The base frame center portion 110 is best seen in FIGS. 1-4, and is anchored by a perimeter foundation member 124. A plate 126 spans the open area defined by the member 124 and a set of flanges 128 extends upwardly from the member 124 and plate 126 to position a pair of support pans 129 extending between pairs of the flanges 128. The support pans 129 cooperate with the patient support assembly 104 to provide a surface upon which a mattress is placed for a patient to use. This surface, which may be manipulated in configuration as will be described herein, enables the patient to be placed in a variety of selected orientations according to selections made by the operator.

Both of the base frame forward portion 112 and back or rear portion 116 are formed of spaced longitudinal channel members 130 and longitudinally spaced transverse channel members 132 affixed together on ends thereof. The back-most transverse channel member 132 of the back portion 116 also has a set of sleeves 133 with a solid bottom for removable insertion of the risers 119 to hold the same in position. A headboard 135 may also be mounted to the risers 119 and may be removed if desired.

Figure 11:
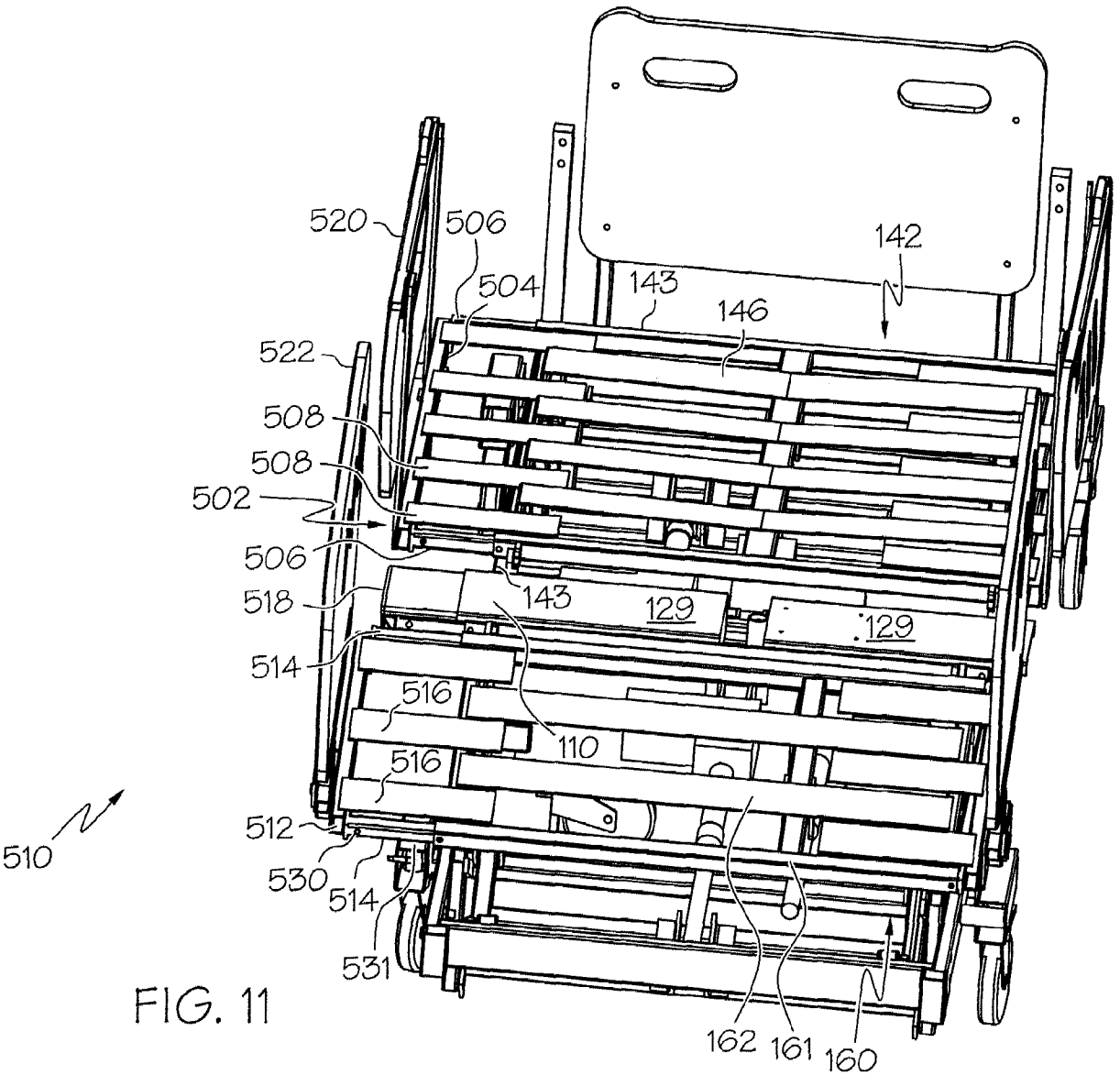
FIG. 11 is a partial close-up front perspective view of the bariatric transport of FIG. 9, showing the frame extensions of the patient support assembly in a substantially extended position.
Figure 12:
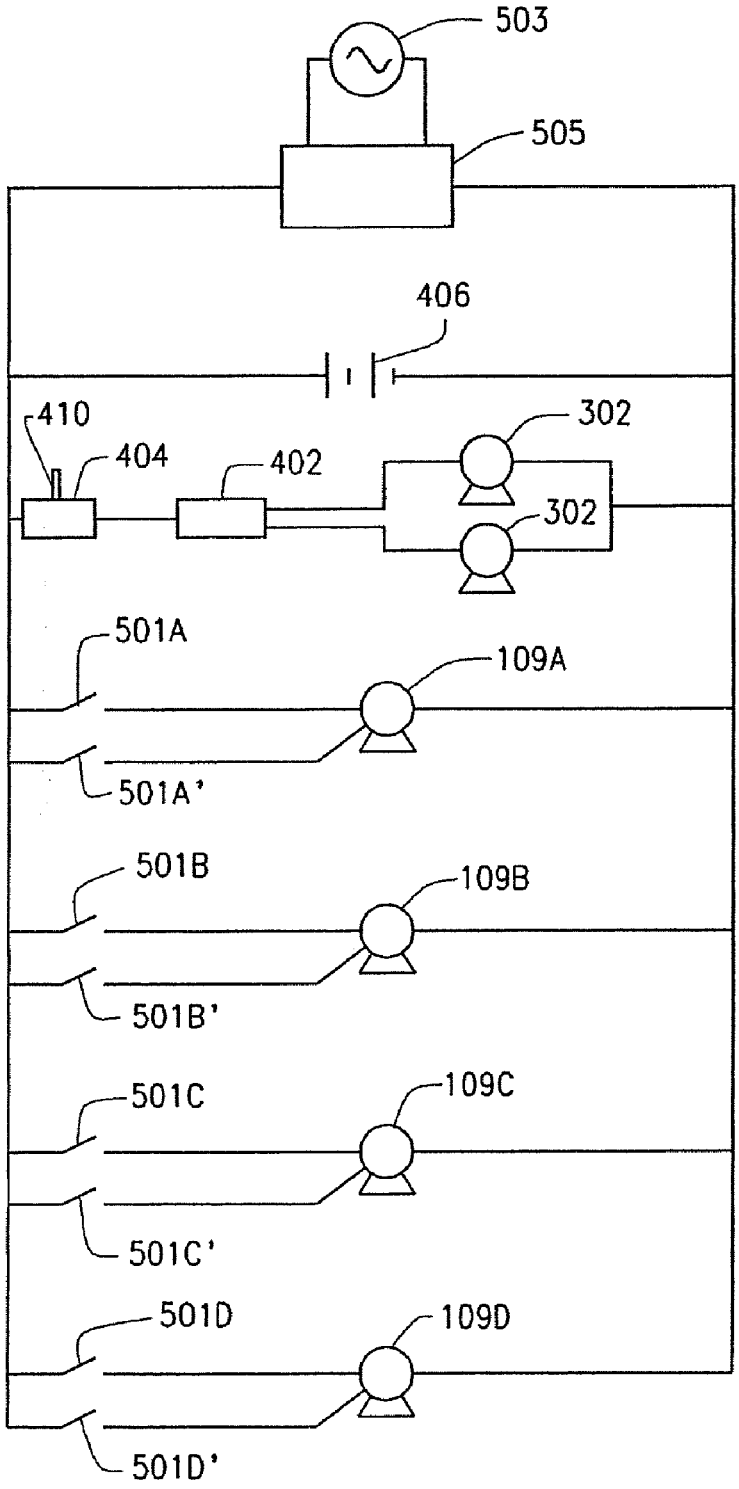
FIG. 12 is simplified schematic of the control system for the various drives to the bariatric transport.

Each of the base frame forward and back portions 112, 116 are hingedly attached to the base frame center portion 110 such that the forward and back portions 112, 116 may be rotated vertically upward in facing relation with one another and locked together in a storage position for the transport 100 such that the same may be placed in a compact space, in generally the same fashion as is shown in FIGS. 11 and 12 of U.S. Pat. No. 6,516,479. A transport tube (not shown) may be fitted into tubing 134 affixed to the base frame center portion 110 and retaining clips (not shown) may be used to connect each of the base frame forward portion 112 and back portion 116 with the transport tube to securely hold the transport 100 in the storage position. Hinges 136 provide the attachment between the perimeter foundation member 124 of the center portion 110 and the spaced transverse channel members 132 of the forward portion 112 and back portion 116.

Figure 2:
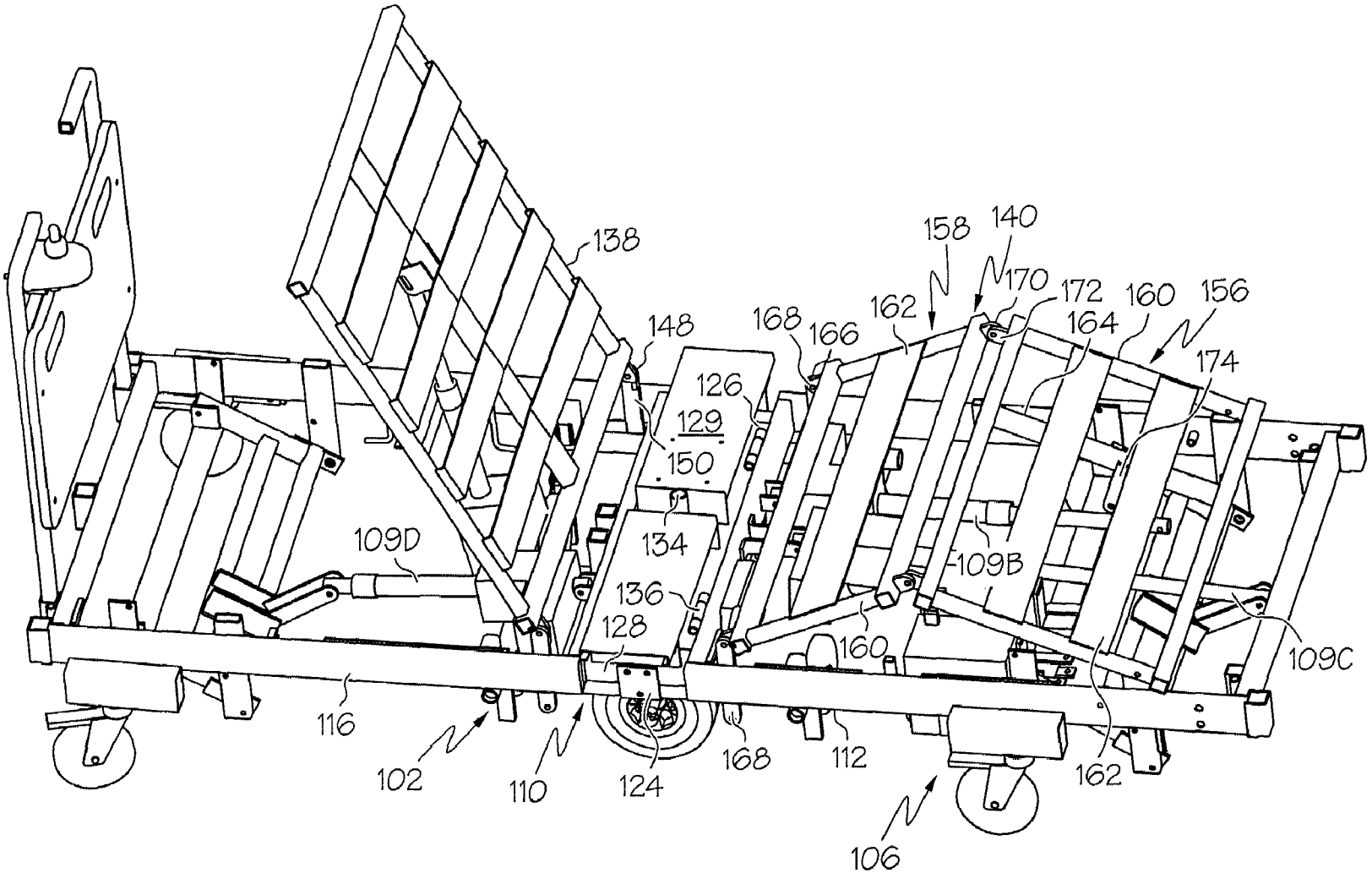
FIG. 2 is a partial close-up front perspective view of the bariatric transport of FIG. 1, showing the center portion and forward portion of the base frame and the articulating foot support of the transport.

The patient support assembly 104, best seen in FIGS. 1 and 2, includes an articulating head or upper body support 138 generally overlying the back portion 116 of the base frame 102 and an articulating foot or lower body support 140 generally overlying the forward portion 112 of the base frame 102. As mentioned previously, the head support 138 and foot support 140 combine with the base frame center portion 110 to provide a surface upon which a mattress may be placed for support of a patient.

The articulating head support 138 has a perimeter frame 142, a center beam 144, and a plurality of support plates 146 spanning transversely to interconnect the frame 142 and beam 144. Pivotable motion of the articulating head support 138 relative to the base frame 102 is enabled by a pinned connection between a pair of brackets 148 extending from the perimeter frame 142 and a pair of bars 150 rigidly connected with the base frame back portion 116. A first actuator 109A has a pinned connection on one end with an actuator support plate 152 affixed to the center beam 144 of the articulating head support 138 and also has a pinned connection on an opposite end with an actuator fork 154 rigidly connected to the perimeter foundation member 124 of the center portion 110 of the base frame 102, thereby functioning through extension and retraction of actuator 109A to raise and lower the head and torso of a patient positioned on the assembly 104.

The articulating foot support 140 (FIG. 2) is divided into a fore section 156 and an aft section 158. Both the fore section 156 and aft section 158 have a perimeter frame 160 and a plurality of support plates 162 spanning transversely to interconnect portions of the frame 160. The fore section 156 also has a longitudinal beam 164 perpendicular to the support plates 162 and interconnecting portions of the frame 160. A first pinned connection is implemented between a pair of first brackets 166 extending from the perimeter frame 160 of the aft section 158 and a pair of bars 168 rigidly connected with the base frame forward portion 112, and a second pinned connection is implemented between a pair of second brackets 170 extending from an opposite end of the perimeter frame 160 of the aft section 158 from the first brackets 166 and a pair of brackets 172 extending from the perimeter frame 160 of the fore section 156. A second actuator 109B has a pinned connection on one end with an actuator support plate 174 rigidly connected to the longitudinal beam 164 of the fore section 156 (FIG. 6) of the articulating foot support 140 and also has a pinned connection on an opposite end with an actuator fork 176 (FIG. 3) affixed to the channel member 132 on a side of the center portion 110 of the base frame 102 opposite of the actuator fork 154 of the first actuator 109A. Thus, the second actuator 109B functions through extension and retraction of the same to both (a) rotate the fore section 156 of the articulating foot support 140 relative to the aft section 158 thereof, and (b) rotate the aft section 158 relative to the center portion 110 of the base frame 102, which thereby, for the patient on the assembly 104, causes a bending of their legs at the knee to elevate and lower various portions of the patient's legs.

Figure 3:
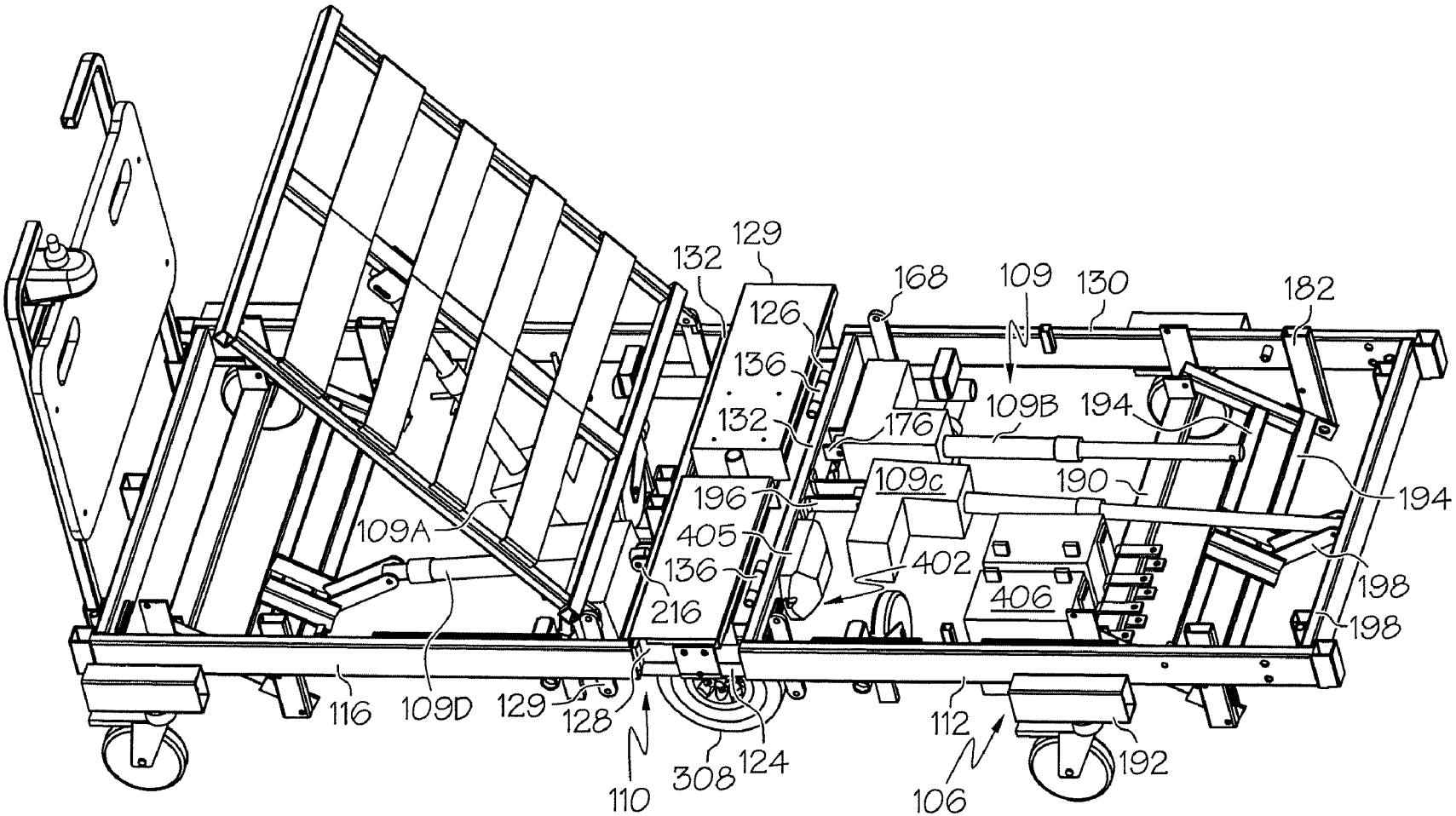
FIG. 3 is a partial close-up front perspective view of the bariatric transport of FIG. 1, showing the center portion and forward portion of the base frame and with the articulating foot support of the transport removed to show other features of the bariatric transport.
Figure 4:
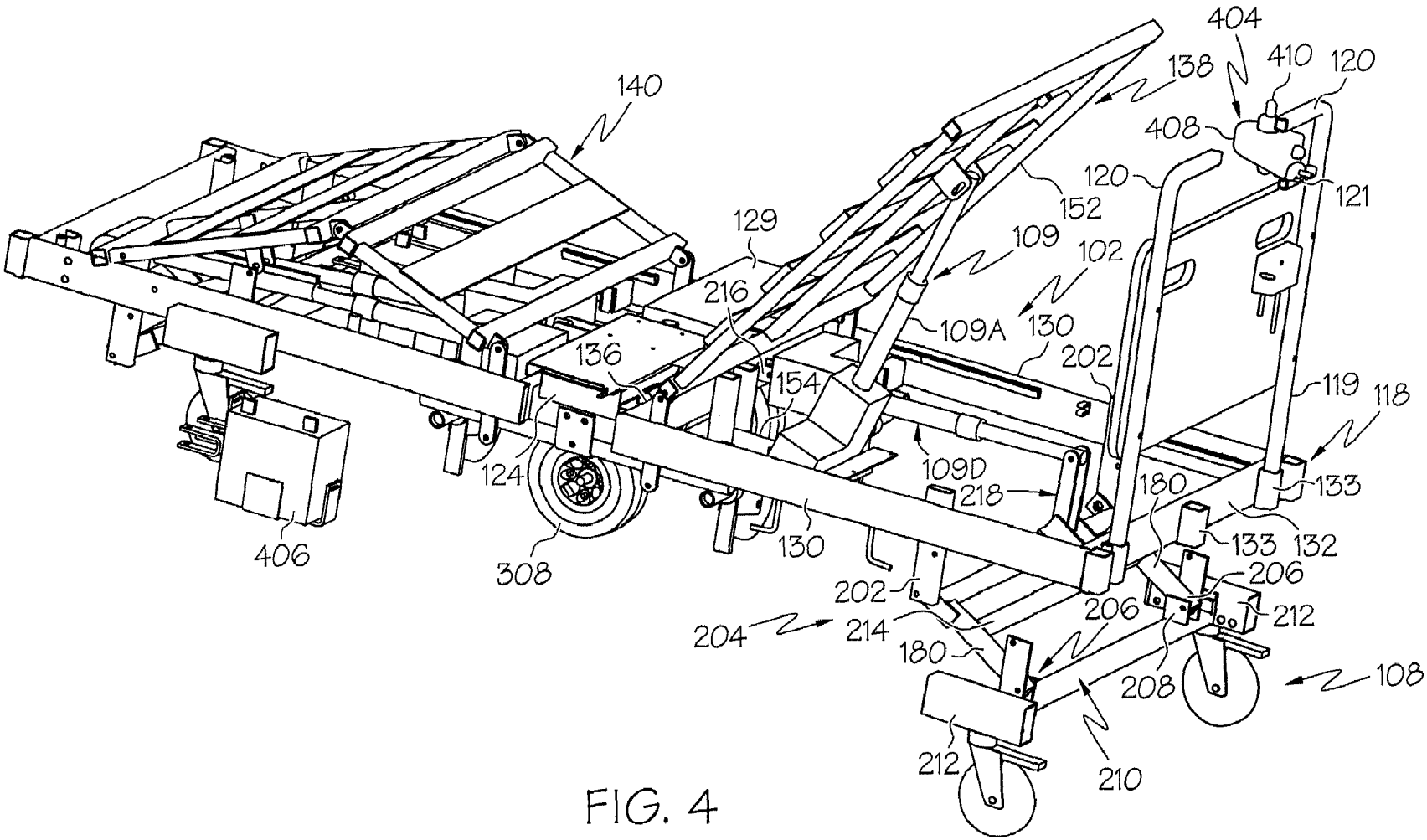
FIG. 4 is a partial close-up rear perspective view of the bariatric transport of FIG. 1, showing the center portion and rear portion of the base frame and the trailing high-low linkage positioned to remove the drive wheels from contact with the floor.
Figure 5:
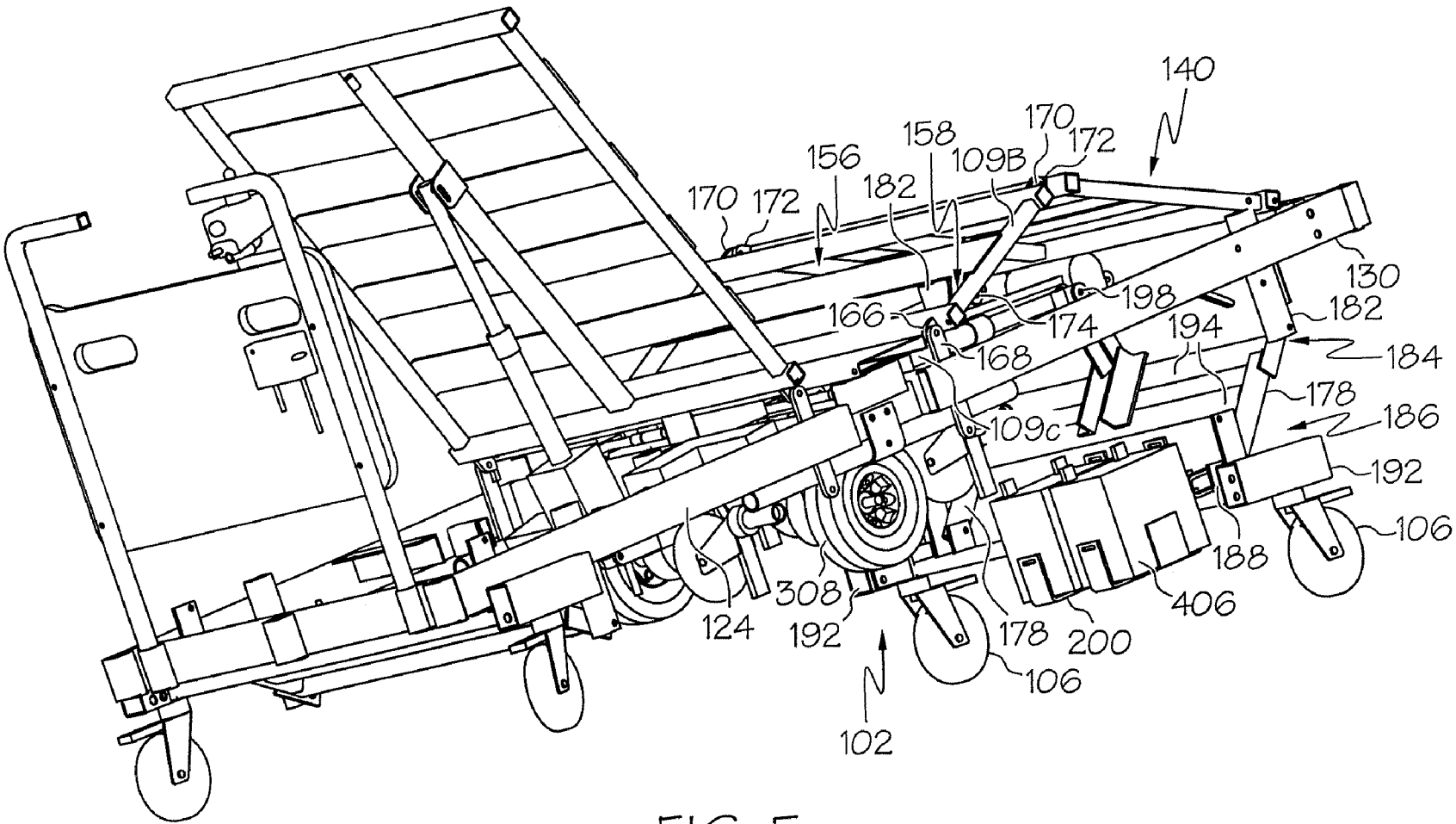
FIG. 5 is a partial close-up rear perspective view of the bariatric transport of FIG. 1, showing the center portion and forward portion of the base frame and the leading high-low linkage positioned to remove the drive wheels from contact with the floor.

Turning to FIGS. 4 and 5 specifically, but with continued reference to FIGS. 1-3, a leading high-low linkage 178 and a trailing high low linkage 180 are provided for coupling the leading stabilizing wheels 106 and trailing stabilizing wheels 108, respectively, to the base frame 102. In combination with a third actuator 109C and a fourth actuator 109D, the leading and trailing high low linkages 178, 180 serve to raise and lower the transport 100 relative to an underlying surface. Raising of the transport 100 may be desired when a worker needs better access to the patient to examine them or perform other tasks, and also removes the drive wheels 308 from engagement with the surface so that only manual movement of the transport 100 is possible.

Raising and lowering of the forward portion 112 of the transport 100 may be accomplished with the following structure coupled with the leading high-low linkages 178 and best seen in FIG. 5. A pair of linkage mounting bars 182 is rigidly connected with the longitudinal channel members 130 of the base frame forward portion 112. The leading high-low linkages 178 each have an upper end 184 pivotably connected with one of the linkage bars 182 and a lower end 186 pivotably connected with a vertical flange 188 extending from a horizontal brace 190 (FIG. 6) interconnecting a pair of mounting bars 192. Each mounting bar 192 is adapted for having mounted therewith one of the leading stabilizing wheels 106. A pair of horizontal support members 194 span between the high-low linkages 178 and serve to transfer forces from the third actuator 109C to the linkages 178. The third actuator 109C has a first pinned connection with an actuator fork 196 rigidly connected to the perimeter foundation member 124 of the base frame center portion 110 adjacent actuator fork 154 (FIG. 4) of the first actuator 109A, and a second pinned connection with an actuator support member 198 mounted on the horizontal support members 194. Thus, extension and retraction of the third actuator 109C causes rotation of the leading high-low linkages 178 (FIG. 5) and corresponding movement of the leading stabilizing wheels 106 relative to the base frame 102. Additionally, a bracket system 200 may be used to secure batteries 406 in place for providing electrical power to the control system 400, as will be explained in more detail below (FIG. 5).

Likewise, raising and lowering of the back portion 116 of the transport 100 may be accomplished with the following structure coupled with the trailing high-low linkages 180 and best seen in FIG. 4. A pair of linkage mounting bars 202 is rigidly connected with the longitudinal channel members 130 of the base frame back portion 116. The trailing high-low linkages 180 each have a proximal end 204 pivotably connected with one of the linkage bars 202 and a distal end 206 pivotably connected with a vertical flange 208 extending from a horizontal brace 210 interconnecting a pair of mounting bars 212. Each mounting bar 212 is adapted for having mounted therewith one of the trailing stabilizing wheels 108. A pair of horizontal support members 214 span between the high-low linkages 180 and serve to transfer forces from the fourth actuator 109*d* to the linkages 180. The fourth actuator 109D has a first pinned connection with an actuator fork 216 rigidly connected to the channel member 132 of the base frame center portion 110 adjacent actuator fork 176 of the second actuator 109B, and a second pinned connection with an actuator support member 218 mounted on the horizontal support members 214. Thus, extension and retraction of the fourth actuator 109D causes rotation of the trailing high-low linkages 180 and corresponding movement of the trailing stabilizing wheels 108 relative to the base frame 102 to raise and lower the base frame 102 and wheels 308.

Figure 6:
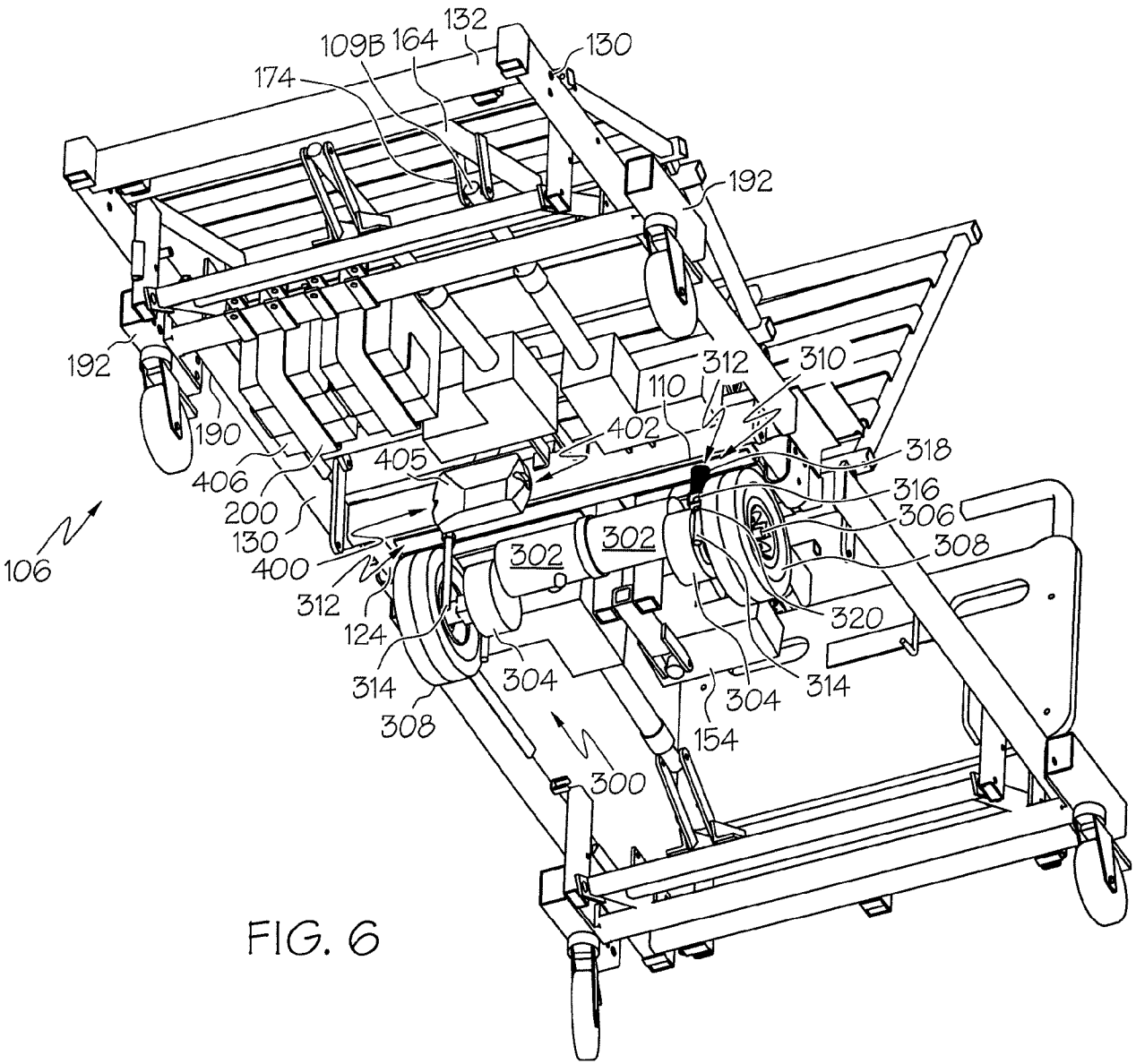
FIG. 6 is a partial bottom front perspective view of the bariatric transport of FIG. 1, showing in particular the drive assembly, suspension apparatus and control module.
Figure 7:
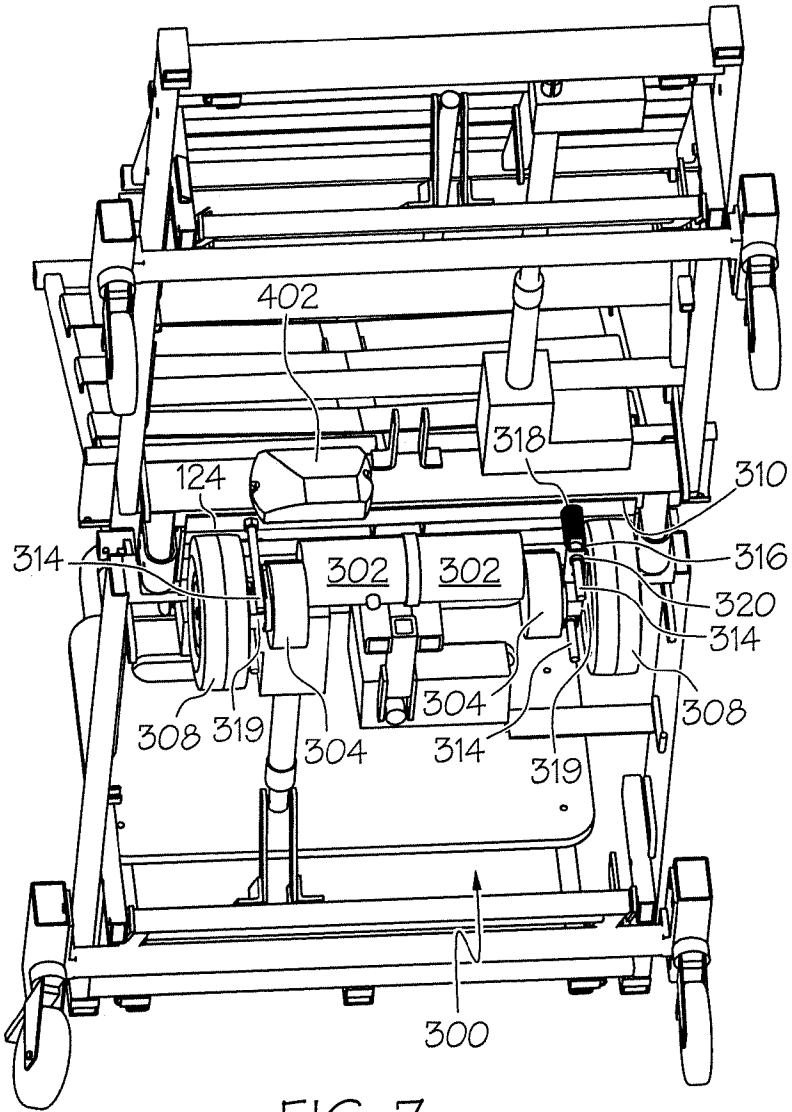
FIG. 7 is a partial close-up bottom front perspective of the bariatric transport of FIG. 1, showing more detail of the drive assembly and suspension apparatus.

Turning to FIGS. 6 and 7, the drive assembly 300 is shown in detail. The drive assembly 300 includes a drive motor means 302 preferably having axially aligned initial outputs extending in opposite directions, a gear box 304 coupled with each output, and an output shaft 306 extending from each of the gear boxes 304 such that the dual output shafts 306 are also preferably axially aligned and extending in opposite directions for mounting of the drive wheels 308 thereon. The gear boxes convert the rotational rate (angular velocity) of the initial outputs of the drive motor means to an output shaft rotational rate (angular velocity) that is appropriate for propelling the transport over a range of desired rates speeds and directions. One suitable drive assembly 300 that may be implemented (with drive wheels 308) is the powered axle drive assembly disclosed in U.S. Pat. No. 6,727,620, issued to White et al., and entitled "Apparatus and Method for a Dual Drive Axle", the teachings of which are incorporated herein by reference. The powered axle drive assembly of the '620 patent provides a unitary unit that may serve as the drive assembly 300 with the drive motor means 302 presenting the initial outputs as being independently controlled by separate rotor assemblies such that the final output shafts 306 rotate each drive wheel 308 in a direction and with a rotational speed that is independent of the rotation of the other drive wheel 308. The drive wheels 308 are preferably gel filled tires or solid tires that require less maintenance than pneumatic air filled tires.

Preferably, the drive assembly 300 is disposed longitudinally along the base frame 102 of the transport 100 proximal to the center portion 110 thereof, and laterally such that the central longitudinal axis of the base frame 102 bisects the drive assembly 300 with the drive wheels 308 positioned approximately equidistant from the central longitudinal axis. This helps with balance and allows the transport 100 to turn in either direction on an underlying surface or floor essentially in position with little or no lateral movement across the surface (i.e., with as short a turning radius as is reasonable or possible). Short turning radiuses are highly desirable particularly when the transport 100 is in tight spaces or when a sharp turn (e.g., 90 degrees or more) needs to be made.

Figure 8:
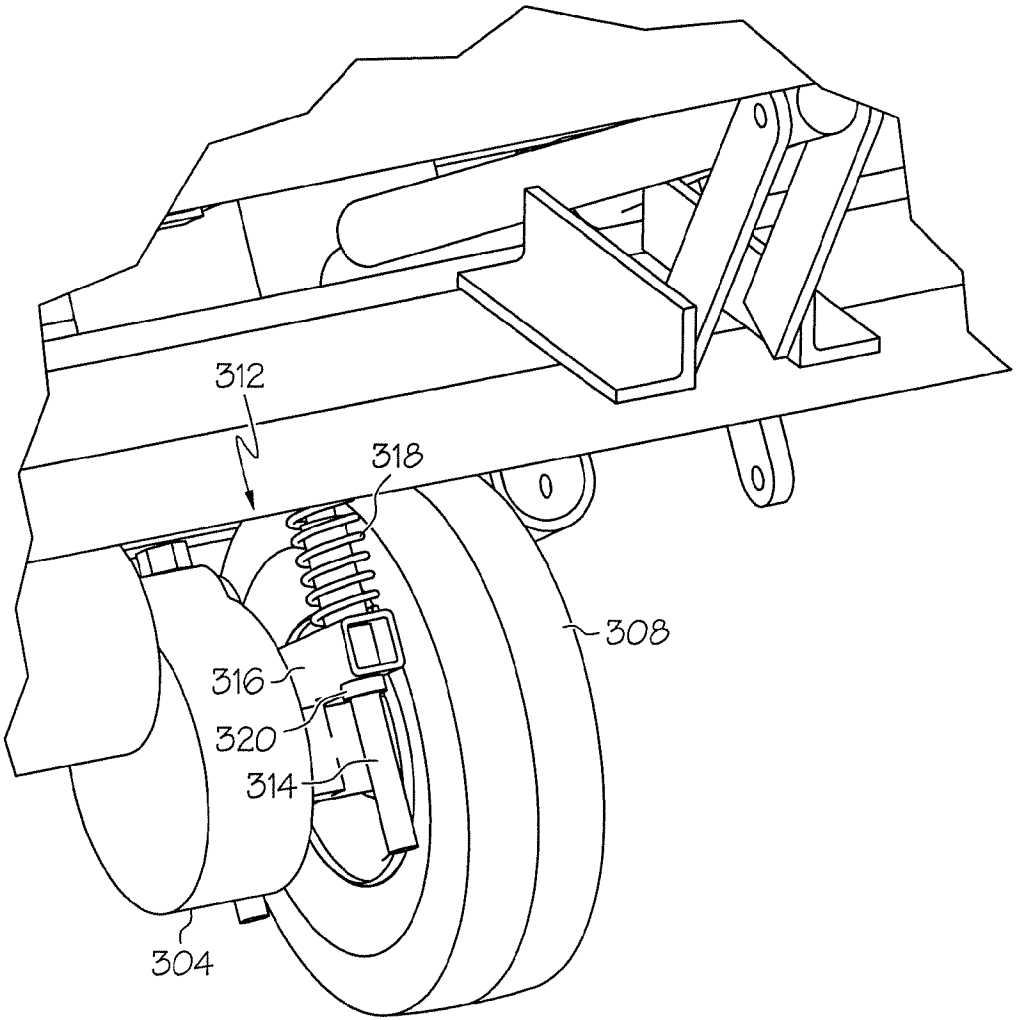
FIG. 8 is a partial close-up front perspective of the bariatric transport of FIG. 1, showing more detail of the suspension apparatus.

Coupling of the drive assembly 300 to the base frame 102 is preferably accomplished by suspending the drive assembly 300 from the frame 102 with a suspension apparatus 310, best seen in FIGS. 6-8. The suspension apparatus 310 provides a degree of shock absorption for the patient as the transport 100 is rolled across a surface, but more importantly, ensures that the drive wheels 308 maintain contact with the surface as the surface has transition points in slope where not all of the drive wheels 308, leading stabilizing wheels 106 and trailing stabilizing wheels 108 would normally contact the underlying surfaces and can each pivot about their own axis. One example of this is when the transport 100 is moving between a ramp and a generally flat surface where at some points only the leading and trailing stabilizing wheels 106, 108 (and not the drive wheels 308) would be contacting the ramp or surface if all the wheels were mounted without suspension. The suspension apparatus 310 gives the drive wheels 308 a range of motion generally perpendicular to the direction of movement of the transport across a surface.

The suspension apparatus 310 includes a set of components 312 mounted proximal to each of the drive wheels 308. Each component set 312 includes a pair of mounting rods 314 extending downwardly from the perimeter foundation member 124 of the base frame center portion 110, a stabilizing bar 316 interconnecting the mounting rods 314 together, and a pair of compression springs 318 managing vertical displacement of the drive assembly 300 relative to the base frame 102. The stabilizing bar 316 is rigidly connected to a collar 319 of the drive assembly 300 enclosing the respective output shaft 306 and near opposing ends thereof has vertically oriented bores through which one pair of mounting rods 314 extends. Bushings 320 may be provided and fitted around the mounting rods 314 and fixedly within the bores to facilitate sliding movement of the rods 314 axially through the bores. The springs 318 are fitted around the mounting rods 314 and are seated on a lower end thereof on the upper surface of the stabilizing bar 316 and on an upper end thereof against the base frame center portion 110. Springs 318 are selected with physical properties that provide extension and thus downward movement of the drive assembly 300 along the mounting rods 314 when a negative transition or concave surface feature is reached by the drive wheels 308 (e.g., between a flat surface and an upwardly sloping incline or ramp) to maintain the wheels 308 in contact with the surface feature, and provide compression and thus upward movement of the drive assembly 300 along the mounting rods 314 when a positive transition or convex surface feature is reached by the drive wheels 308 (e.g., at the crest of a hill) to maintain the leading and trailing stabilizing wheels 106, 108 in contact with the surface feature. Additionally, the dual suspension feature—providing the suspension component sets of components 312 near each of the drive wheels 308—aids in maintaining drive wheel contact 308 with the underlying surface when uneven terrain or surface features are reached which affect the wheels independently (e.g., uneven terrain, curb drop-offs, hitting a ramp other than "square" or such) or when the transport 100 has uneven lateral weight distribution based on the patient or equipment placed upon the transport. Although two separate motor means 302 are shown, a single motor 302 may be used and can be used to drive both wheels 308 independently as for example through a series of clutches and drive elements.

As can be seen throughout the Figures, the control system 400 includes, in one embodiment, a control module 402 (FIG. 6) and an input device 404 (FIG. 4). The control module 402 is electrically coupled with the drive motor means 302 and with the input device 404. If desired, the control module 402 and input device 404 may be integrated together into a single unit; the embodiment of the control system 400 seen throughout the Figures, however, it is preferable that the control module 402 and device 404 be separate units to reduce the distance between the drive motor means 302 and the control module 402 supplying electrical power thereto, reducing power loss. One or more batteries 406, preferably two, supply electrical power for the control system 400. Preferably, the batteries are of the rechargeable type. Preferably, the control module 402 has a number of input and output leads to which the drive motor means 302, input device 404 and batteries 406 are connected through wiring or cabling (not shown). Additionally, one location where the control module may be mounted is onto the perimeter foundation member 124 of the base frame center portion 110. A battery charger may be mounted, for example, on headboard 135 and has the necessary cabling for supplying power from a typical A/C electrical outlet to the batteries 406.

One suitable control module 402 and input device 404 combination is the SHARK model controller arrangement of Dynamic Controls, Christchurch, New Zealand. The control module 402 provides circuitry in the form of a compact module with a protective housing, and further operates in a so-called "dual mode" fashion so that the control module 402 may communicate with the input device 404 (e.g., by receiving input signals from the device 404) as well as supply electrical power thereto. In this way, the batteries 406 do not have to supply electrical power directly to the input device 404, but only through the control module 402 to the input device 404 when it is needed. This arrangement reduces the amount of power cabling needed in the control system, as such cabling does not have to be extended to the input device 404. Alternatively, the control module 402 and input device 404 may be in the form of an single integrated controller residing in a single housing and receiving power directly from the batteries 406.

The control system 400 may be configured to operate on 24 volt DC power such that the pair of batteries 406 are preferably each a deep cycle 12 volt DC type battery. Additionally, the batteries 406 are ideally a type of battery that does not require water or is otherwise sealed so that the tilting of the battery to various positions when the transport is in a folded state for storage or moving into a narrow area does not result in spillage of battery contents. For example, the batteries 406 may be gel filled or a sealed lead acid battery. Additionally, circuit breakers may be provided with the batteries when excessive current is being drawn by the components of the control system 400 and/or drive assembly 300.

The control module 402 includes in one embodiment, within a housing 405, a processor (e.g., microprocessor, microcontroller or application-specific integrated circuit) for receiving inputs from the input device 404 or other devices (e.g., a speed sensor measuring the rate of rotation of the drive wheels 308) and managing the amount of electrical power supplied through outputs to the drive motor means 302, and a memory device for storing program code or other data. A current reversing device, such as one or more relays, may also be provided in the control module 402 to control the direction of current flow supplied to the drive motor means 302. By controlling the supply of electrical power in accordance with operator input received on the input device 404, and optionally, with sensed rotational speed of each drive wheel 308, the control module 402 regulates the amount of power output of the drive motor means 302 for each output shaft 306. Similarly, based on the operator input received on the input device 404 (i.e., direction of travel for the transport 100), the control module 402 determines the direction of current flow supplied to each output shaft 306 of the drive motor means 302 to cause drive wheel 308 rotation in a desired direction. For instance, if a measured speed of rotation of the drive wheels 308 is less than a speed of travel for the transport selected on the input device 404, such as when the transport 100 encounters resistance from gravity when traveling up a ramp, the control module 402 will draw more current from the battery 406 to the drive motor means 302 to produce more motive power.

The input device 404 is configured to generate a signal based on the input received from a operator and transmit the signal to the control module 402 to control drive motor means 302 operation. Preferably, the input device 404 includes a housing 408, a joystick lever 410 mounted with the housing for accepting operator inputs regarding a direction of travel or rotation for the transport 100, a rotatable speed control knob 412 mounted with the housing for selecting a speed of travel/rotation, and circuitry (not shown) to process the input received through lever 410 and knob 412 and generate a command signal for transmission to the control module 402. The joysticks lever 410 may be positioned in a generally vertical orientation when in a neutral position but may also be positioned in various neutral position orientations by moving the control module to other orientations. For example, the joysticks lever 410 may be generally horizontal in neutral. The circuitry for the input device 404 may include a processor and memory device similar to that of the control module 402. The input device 404 may also include an LED display (not shown) providing a visual indication of different operating conditions of the device 404 and a horn (not shown). Also, the input device 404 is preferably mounted on a lateral member 121 extending from one of the risers 119 of the base frame back end 118 proximal to and below one of the handles 120. This allows the joystick lever 410 and other input capturing means on the device 404 to be easily reached by the operator guiding the transport movement without completely removing their hand from the handle 120.

The input device 404 may be programmed to customize how certain movements of the joystick lever 410 will generate command signals for transmission to the control module 402 regulating current flow to the drive motor means 302. One exemplary movement scheme for the transport 100 under control of the input device 404 is shown in Table 1. This scheme may be implemented when the input device 404 is mounted on the lateral member 121 the base frame back end 118 to position the joystick lever 410 for control of the activity of the drive wheels 308.

TABLE 1

| Direction of Movement of Joystick Lever | Movement Pattern of Transport |
|---|---|
| Forward | Forward Along the Central Longitudinal Axis of Transport |
| Back | Backward Along the Central Longitudinal Axis of Transport |
| Left | Turning of Forward Portion of Transport to Left or Counterclockwise Around A Vertical Axis Bisecting Drive Assembly (i.e., rotation in place to left) |
| Right | Turning of Forward Portion of Transport to Right or Clockwise Around A Vertical Axis Bisecting Drive Assembly (i.e., rotation in place to right) |
| Forward and Left | Turning of Forward Portion of Transport to Left as Transport Moves Forward |
| Forward and Right | Turning of Forward Portion of Transport to Right as Transport Moves Forward |
| Back and Left | Turning of Forward Portion of Transport to Left as Transport Moves Backward |
| Back and Right | Turning of Forward Portion of Transport to Right as Transport Moves Backward |

The movement scheme managed by the input device 404 is realized despite the fact that the mounting thereof on the lateral member 121 is at 90 degrees of rotation from the standard mounting direction of the input device of the SHARK model controller. Programming of the input device 404 to change the movement pattern of the bed in accordance with the joystick movement being 90 degrees off of the standard orientation ensures that operators of the input device 404 can learn movement control for the transport in the most logical way. This input device 404 mounting positions the same more flush with the handles 120 to reduce accidental contact with the joystick lever 410 by the operator, which would result in unwanted movements of the transport 100, or other contact with the input device 404 that could damage or alter the settings on the device 404. It has been found that with the SHARK model controller, by rotating the input device 404, 90 degrees, as shown in FIG. 1, then the sensitivity of the controller may be enhanced.

The input device 404 is also configured such that—along with the limits of speed set by the speed control knob 412— the magnitude of movement of the joystick lever 410 from the resting center position dictates the speed of movement of the drive wheels 308, and thus the transport 100. The theoretical upper speed limit of the transport 100 is regulated by the degree of rotation of the speed control knob 412 on the input device 404 (FIG. 1); however, the "Back and Left" and "Back and Right" movements preferably are set to have a lower speed than the various forward movements due to safety concerns of having the transport 100 move towards the operator of the input device 404.

The LED display may take on a variety of forms to communicate various control system 400 conditions to the operator. Exemplary system conditions may include: state of battery 406 charging; security condition or "locking" of the input device 404 to prevent unauthorized use; programming mode where inputs received through the joystick lever 410 and speed control knob 412 of the input device 404 may be set to produce various effects (e.g., increased speed of transport movement options with knob 412, selections on lever 410 produce differing movement patterns from default movement patterns); movement pattern selections on joystick lever 410 that are not allowed in the current control system 400 operating mode; detection of faults or other electrical problems with control system 400; etc.

The drive assembly 300 may be configured to accomplish braking (optionally with assistance from the control system 400) according to three different schemes: regenerative, dynamic and static friction braking. For regenerative braking, when the sensed speed of rotation of the drive wheels 308 exceeds the speed of the transport selected on the input device 404, such as when the transport 100 is traveling down an incline, the drive motor means 302 switches to electrical generation mode to recharge the batteries 406. Dynamic braking is engaged when the joystick lever 410 is released by the operator and returns to the neutral center position, and works to create an electrical short in the drive motor means 302 that prevents rotation of the drive wheels 308. Static friction breaking involves compression of a break pad with a component of the drive assembly 300 (e.g., wheels 308 or output shafts 306), and aids in maintaining the transport 100 at a stop when the same is on, for example, and incline where "creep" may result from utilizing dynamic breaking alone.

FIG. 12 illustrates a simplified schematic, the control system 400, described above, includes the input device 404 that is operably connected to the control module 402 which in turn is connected to the motors 302. The input device 404 may be removably mounted to the headboard 135 for operation convenience and removal of the headboard 135. It may also be provided with a plug connection for removal of the input device 404 to prevent unauthorized power operation of the transport 100. Other plug connections may be provided to allow removal of various of the electrical components from the transport 100. The system is powered by an energy source such as a capacitor, battery 406 or any other suitable device that preferably has an electrical output for powering not only the control system 400 but the actuators 109A-D. Additionally, as described above, two motors 302 are provided each independently operable. However, it is to be understood that the drive means could include a series of clutches and independent drives and utilize only one motor 302. The drives could also be hydraulic or any other suitable drives that permit independent rotation of each of the drive wheels. The actuators 109A-D can be motor driven screws with the motors being reversible and controlled by respective switches 501A-D and 501A'-D'. For example, the switches 501A-D can be for extending the actuators 109A-D while the switches 501A'-D' can be for retracting actuators 109A-D. The switches 501 may be mounted on a control panel adjacent the input device 404 or may be positioned adjacent to the actuator 109A-D to be actuated. A battery chargers 505 (FIG. 12) may be provided for connection to a power source 503, such as a wall outlet to maintain the battery 406 charged.

Figure 9:
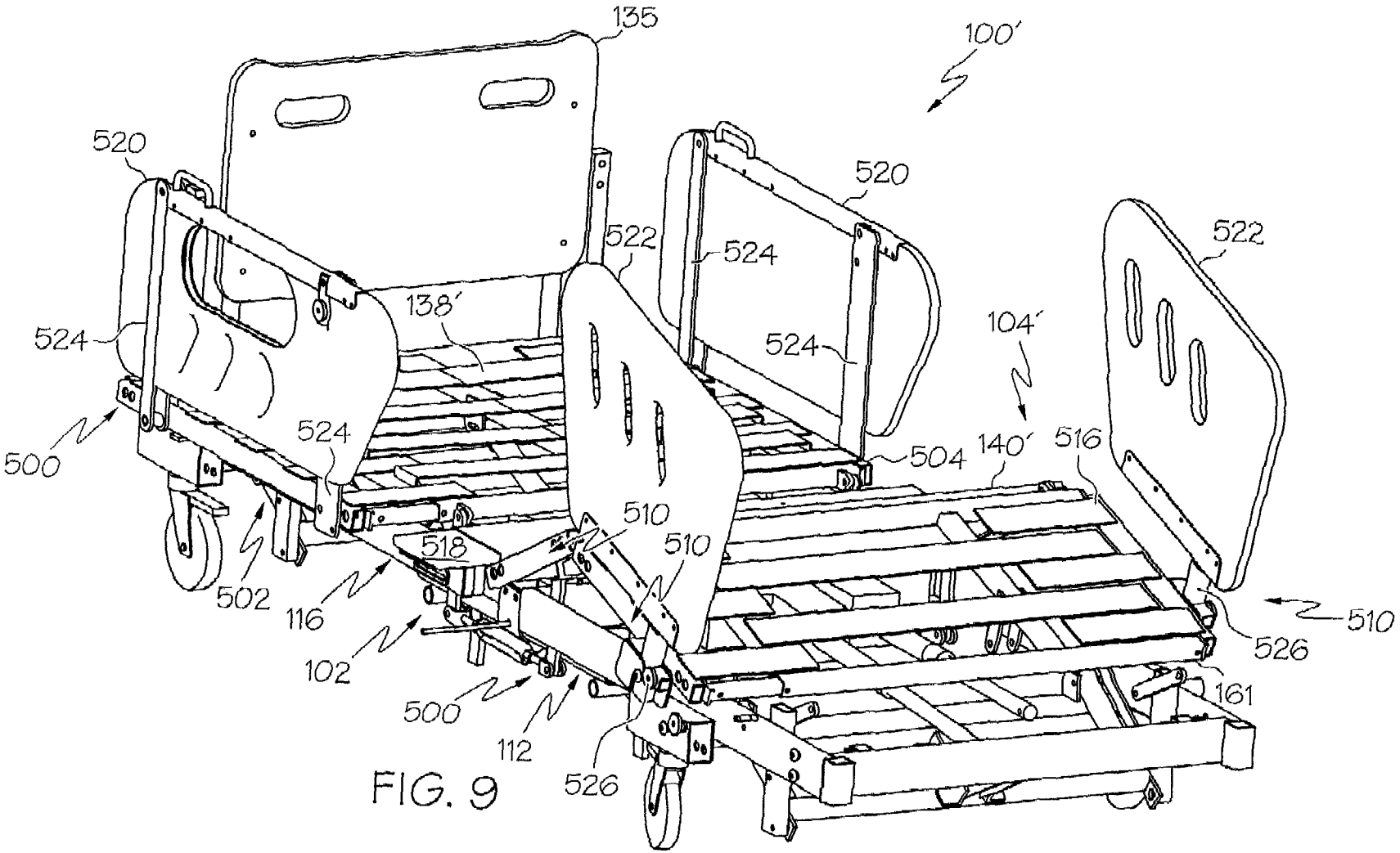
FIG. 9 is a front perspective view of another embodiment of a bariatric transport of the present invention.
Figure 10:
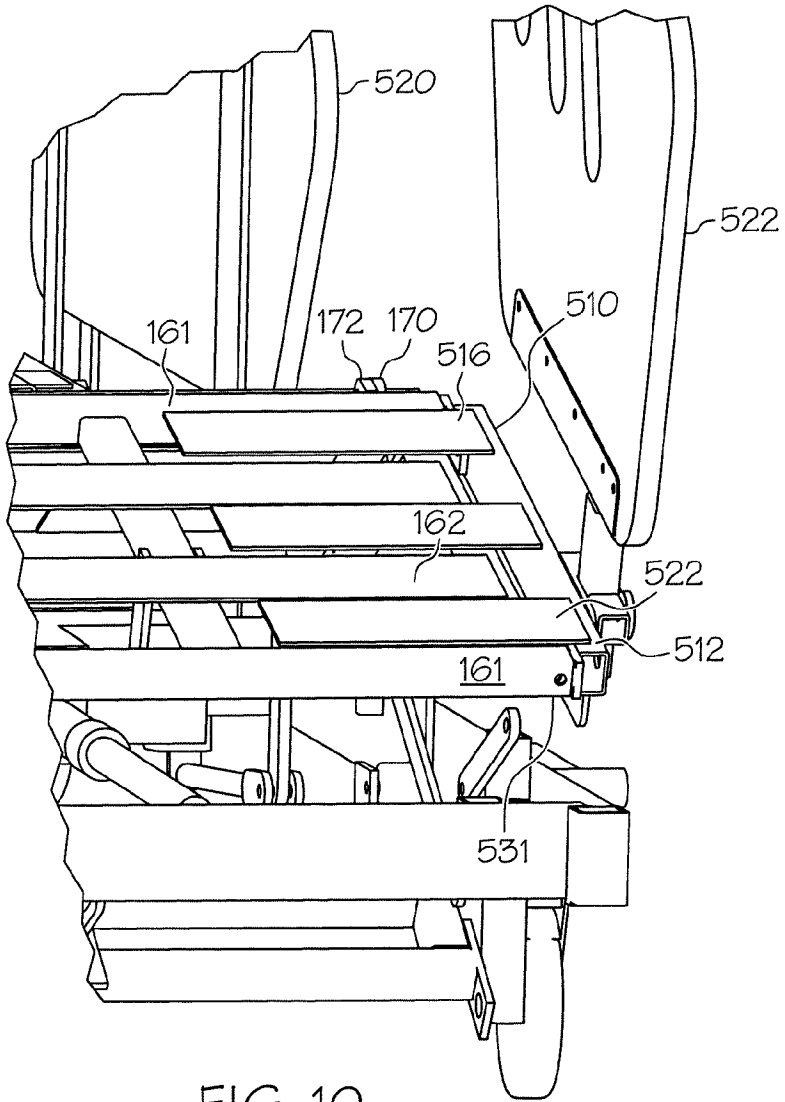
FIG. 10 is a partial close-up front perspective view of the bariatric transport of FIG. 9, showing the patient support assembly having frame extensions in a substantially non-extended position.

Turning to FIGS. 9-11, another embodiment of the bariatric transport 100' is shown where frame extensions 500 are implemented for selectively increasing the width of the articulating head support 138 and articulating foot support 140 of the patient support assembly 104. This allows for a broader range of patients of varying widths to fit on the transport 100' while allowing the patient support assembly 104 to be narrowed when necessary to pass, for example, through a narrow hall or doorway.

In this embodiment of the bariatric transport 100', a set of head support extensions 502 are configured to be slidably received within opposing ends of transverse sleeves 143 (FIG. 11) of the perimeter frame 142 of the articulating head support 138. Each head support extension 502 includes a longitudinal channel member 504 having transverse end members 506 extending from opposing ends thereof for being received into the transverse sleeves 143. Additionally, support plate extensions 508 extend on one end from the longitudinal channel member 504 and terminate at a free end. The support plate extensions 508 (FIG. 11) are alternately positioned with respect to the support plates 146 of the articulating head support 138, and have a length sufficient to allow the free end thereof to rest upon on the perimeter frame 142 while the transverse end members 506 slide within the transverse sleeves 143 for proper support of a patient on the support plate extensions 508. Upon continued outward movement of the longitudinal channel member 504 away from the articulating head support 138, the transverse end members 506 will slide out of the transverse sleeves 143, thereby separating the respective head support extension 502 from the transport 100'.

A set of foot support extensions 510 are configured to be slidably received within opposing ends of transverse sleeves 161 of the perimeter frame 160 of the fore section 156 and aft section 158 of the articulating foot support 140. Each foot support extension 510 includes a longitudinal channel member 512 having transverse end members 514 extending from opposing ends thereof for being received into the transverse sleeves 161. Support plate extensions 516 are also included on each foot support extension 510 and span on one end from the longitudinal channel member 512 and terminate at a free end. The support plate extensions 516 are alternately positioned with respect to the support plates 162 of the articulating foot support 140, and have a length sufficient to allow the free end thereof to rest on the perimeter frame 160 while the transverse end members 514 slide within the transverse sleeves 161 for proper support of a patient on the support plate extensions 516. Upon continued outward movement of the longitudinal channel member 512 away from the fore section 156 and aft section 158 of the articulating foot support 140, the transverse end members 514 will slide out of the transverse sleeves 161, thereby separating the respective head support extension 510 from the transport 100'.

A pair of center extensions 518 (FIGS. 9, 11) may be included for use on opposing lateral sides of the transport 100'. Each extension 518 is configured to slidably extend and retract from a sleeve formed by the support pans 129 to adjust the width of the center portion 110 of the base frame 102.

The head support extensions 502 may also have head area sideboards 520 preferable movably connected therewith. The foot support extensions 510 may also have foot area sideboards 522 preferably movably connected therewith. The head support extensions 502 and foot support extensions 510 cooperate to block the patient from moving laterally off of the articulating head support 138 and articulating foot support 140 when desired by the transport 100' operator. The head area sideboards 520 are pivotably mounted to the head support extensions 502 by a pair of bars 524 pivotably coupled on first ends thereof with the one of the longitudinal channel members 504 and on second ends thereof with the corresponding head area sideboard 520. The foot area sideboards 522 are pivotably mounted to the foot support extensions 510 (preferably of the fore section 156) by a pivot block 526 on one of the longitudinal channel members 504. Both the head area sideboard 520 and foot area sideboard 522 may each be rotated downward to a position substantially below a corresponding plane formed by the top of a mattress (not shown) supported by the support plates 146 of the articulating head support 138 and the support plates 162 of the articulating foot support 140 to enable access to the patient by an operator (e.g., health care worker) and/or to remove the patient from the transport 100'.

Suitable selectively usable stops or locks may be provided to fix the extensions 502, 510 in pre-selected sideways extended or retracted positions or pivoted positions. A suitable stop for extension could be a pin with a spring loaded detent such as a hitch pin receivable in aligned apertures 530, 531 in the sleeves 143, 161 and member 503, 514. A similar arrangement may be used with the pivot block 526.

From the foregoing, it may be seen that the bariatric transport of the present invention displaying increased maneuverability and control by an operator over prior designs is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

The invention claimed is:

1. A maneuverable bariatric bed transport adapted for supporting a patient thereon comprising:

a base frame;

a patient support assembly coupled with and overlying the base frame;

a drive assembly coupled with the base frame, the drive assembly including, at least one drive motor, first and second drive means connected to the at least one drive motor, and a pair of drive wheels, each wheel adapted to be independently rotatably actuated by a first or second drive means;

a suspension apparatus for coupling the drive assembly with the base frame and for facilitating at least vertical movement of the drive assembly relative to the base frame; and a first and second high-low linkage coupled to the base frame and configured to raise and lower the transport;

wherein the suspension apparatus disengages the drive wheels when the base frame is in a raised position.

2. The bariatric bed transport of claim 1, further comprising:

at least two leading stabilizing wheels coupled to said first high-low linkage; and at least two trailing stabilizing wheels coupled to said second high-low linkage.

3. The bariatric bed transport of claim 2, further comprising:

a control system adapted for controlling operation of the drive assembly in response to operator input received by the control system; and a portable electrical power source for supplying electrical power for operation of the drive assembly and the control system;

wherein the control system and drive assembly together enable driving and steering of the bariatric bed transport in a variety of directions across an underlying surface with support from at least one of the stabilizing wheels.

4. The bariatric bed transport of claim 3, wherein the control system comprises:

a control module electrically coupled with the first and second drive motors; and an input device electrically coupled with the control module, the input device being operative to generate a signal for transmission to the control module based on operator input;

wherein the transmitted signal causes the control module to command at least one drive motor of the first and second drive motors to rotate the respective drive wheel in a determined direction of rotation and with a certain torque.

5. The bariatric bed transport of claim 4, wherein the input device is adapted to accept operator input and initiate movement of the transport selectively in accordance with all of the following options:

(a) one of a forward and rearward direction without any rotation of the transport on the underlying surface, (b) rotation on the underlying surface with at most slight lateral movement of the transport across the underlying surface, and (c) one of the forward and rearward direction while rotating the transport on the underlying surface.

6. The bariatric bed transport of claim 1, wherein the pair of drive wheels is positioned proximate to a point below a center portion of the base frame.

7. The bariatric bed transport of claim 1, wherein the drive assembly includes first and second drive motors each operably connected to a respective drive wheel.

8. The bariatric bed transport of claim 1, wherein the power source includes a battery.

9. The bariatric bed transport of claim 1, wherein the battery includes a rechargeable battery.

10. The bariatric bed transport of claim 8 further comprising a battery charger operatively connected to the rechargeable battery.

11. The bariatric bed transport of claim 3, wherein the control system includes a joystick for receiving the operator input.

12. A maneuverable bariatric bed transport adapted for supporting a patient thereon comprising:

a base frame;

a patient support assembly coupled with and overlying the base frame, the patient support assembly including, a head support pivotably coupled to the base frame and extending generally toward a head end of the transport away from the center portion of the base frame and a free end moving generally toward a foot out of the transport in at least one pivoted position of the head support, an articulating foot support pivotably coupled to the base frame and extending generally toward the foot end from the center portion of the base frame and a free end moving generally toward the head end of the transport in at least one pivoted position of the articulating foot support, the articulating foot support having a second surface formed thereon, a first actuator for pivoting the head support relative to the base frame, and a second actuator for pivoting the articulating foot support relative to the base frame; and a drive assembly coupled with the base frame, the drive assembly including, at least one drive motor, first and second drive means connected to the at least one drive motor, and a pair of drive wheels, each wheel adapted to be independently rotatably actuated by a first or second drive means.

13. The bariatric bed transport of claim 12 further comprising a suspension apparatus for coupling the drive assembly with the base frame and for facilitating at least vertical movement of the drive assembly relative to the base frame.

14. The bariatric bed transport of claim 13, wherein the pair of drive wheels is positioned proximate to a point below a center portion of the base frame.

15. The bariatric bed transport of claim 14 further comprising:

a pair of leading stabilizing wheels coupled with the base frame such that the pair of leading stabilizing wheels are generally positioned forwardly of the pair of drive wheels; and a pair of trailing stabilizing wheels coupled with the base frame such that the pair of trailing stabilizing wheels is generally positioned rearwardly of the pair of drive wheels.

16. The bariatric bed transport of claim 12 further comprising a control system including, a control module electrically coupled with the pair of drive motors, and an input device electrically coupled with the control module, the input device being operative to generate a signal for transmission to the control module based on the operator input, wherein the transmitted signal causes the control module to command at least one drive motor of the pair of drive motors to rotate the respective drive wheel in a certain direction of rotation and with a certain torque, wherein the input device is further adapted to enable variable speed control of the drive assembly based on the operator input received on the input device, and wherein the input device is further adapted to enable variable speed control of the drive assembly based on one of the operator input received on the joystick and additional operator input received on the input device.

17. The bariatric bed transport of claim 16, wherein the input device is adapted to accept operator input and initiate movement of the bariatric bed transport selectively in accordance with all of the following options:

(a) one of a forward and rearward direction without any rotation of the transport on the underlying surface, (b) rotation on the underlying surface with at most slight lateral movement of the transport across the underlying surface, and (c) one of the forward and rearward direction while rotating the bariatric bed transport on the underlying surface.

18. A maneuverable bariatric bed transport adapted for supporting a patient thereon comprising:

a base frame;

a patient support assembly coupled with and overlying the base frame, the patient support assembly including, a head support pivotably coupled to the base frame and extending generally toward a head end of the transport away from the center portion of the base frame and a free end moving generally toward a foot out of the transport in at least one pivoted position of the head support, an articulating foot support pivotably coupled to the base frame and extending generally toward the foot end from the center portion of the base frame and a free end moving generally toward the head end of the transport in at least one pivoted position of the articulating foot support, the articulating foot support having a second surface formed thereon, a first actuator for pivoting the head support relative to the base frame, and a second actuator for pivoting the articulating foot support relative to the base frame; and a drive assembly coupled with the base frame, the drive assembly including, at least one drive motor, first and second drive means connected to the at least one drive motor, and a pair of drive wheels, each wheel adapted to be independently rotatably actuated by a first or second drive means and wherein the pair of drive wheels is positioned proximate to a point below a center portion of the base frame;

a suspension apparatus for coupling the drive assembly with the base frame and for facilitating at least vertical movement of the drive assembly relative to the base frame;

a pair of leading stabilizing wheels coupled with the base frame such that the pair of leading stabilizing wheels are generally positioned forwardly of the pair of drive wheels; and a pair of trailing stabilizing wheels coupled with the base frame such that the pair of trailing stabilizing wheels is generally positioned rearwardly of the pair of drive wheels; and a first and second high-low linkage operatively coupled with the base frame and configured for raising and lowering the base frame;

wherein the leading stabilizing wheels are mounted to the first high-low linkage; and wherein the trailing stabilizing wheels are mounted to the second high-low linkage.

19. The bariatric bed transport of claim 18 wherein the suspension apparatus is configured for disengaging the drive wheels when the base frame is in a raised position.

* * * * *

UNITED STATES PATENT AND TRADEMARK OFFICE

CERTIFICATE OF CORRECTION

PATENT NO. : 7,472,438 B2
APPLICATION NO. : 11/877887
DATED : January 6, 2009
INVENTOR(S) : DuWayne E. Kramer, Jr.

It is certified that error appears in the above-identified patent and that said Letters Patent is hereby corrected as shown below:

On the Title Page Item (75) Inventors: delete "DuWayne E. Karmer, Jr., Lake Quivera, KS" and replace with "DuWayne E. Kramer, Jr., Lake Quivira, KS"; delete "Timothy F. Dunfee, Lake Quivera, KS" and replace with "Timothy F. Dunfee, Lake Quivira, KS"

Signed and Sealed this

Third Day of March, 2009

John Doll

JOHN DOLL
*Acting Director of the United States Patent and Trademark Office*